US007651271B2

(12) United States Patent
Withers

(10) Patent No.: US 7,651,271 B2
(45) Date of Patent: Jan. 26, 2010

(54) RECLOSABLE PLASTIC BAGS

(75) Inventor: Philip Craig Withers, South Bank (AU)

(73) Assignee: International Consolidated Business Pty Ltd., Windsor (AU)

( * ) Notice: Subject to any disclaimer, the term of this patent is extended or adjusted under 35 U.S.C. 154(b) by 0 days.

(21) Appl. No.: 10/415,070

(22) PCT Filed: Jun. 6, 2001

(86) PCT No.: PCT/AU01/00670

§ 371 (c)(1),
(2), (4) Date: Aug. 1, 2003

(87) PCT Pub. No.: WO02/34634

PCT Pub. Date: May 2, 2002

(65) Prior Publication Data

US 2004/0013323 A1 Jan. 22, 2004

(30) Foreign Application Priority Data

Oct. 27, 2000 (AU) ..... PR1056

(51) Int. Cl.
*B65D 33/16* (2006.01)
*B65D 77/18* (2006.01)
*A44B 19/00* (2006.01)

(52) U.S. Cl. ..... 383/63; 383/65; 24/30.5 R; 24/585.12

(58) Field of Classification Search ..... 383/65, 383/63, 59; 24/585.12, 30.5 R
See application file for complete search history.

(56) References Cited

U.S. PATENT DOCUMENTS 3,565,147 A 2/1971 Ausnit
3,974,958 A 8/1976 Ruda
4,363,345 A * 12/1982 Scheibner ..... 383/63
4,701,358 A * 10/1987 Behr et al. ..... 428/35.5
4,822,539 A 4/1989 Tilman et al.

(Continued)

FOREIGN PATENT DOCUMENTS

EP 0 427 010 5/1991

(Continued)

*Primary Examiner*—Jes F Pascua
(74) *Attorney, Agent, or Firm*—Stites & Harbison PLLC; Ross F. Hunt, Jr.; Douglas E. Jackson

(57) ABSTRACT

A reclosable plastic bag (10) having two panels (15) of plastics sheet or film joined to each other along their opposite side edges (12) to define a bag with an opening (13). An extruded closure/sealing means (14) of one or more inter-engagable elongate rib/groove configurations (14*a*, 14*b*) closes the opening, and a plurality of elongate strengthening ribs (18) are also extruded adjacent, and parallel, to the closure/sealing means (14) on each of the panels of the bag and also inwardly and outwardly of the closure means. A plurality of shallow ribs (17) are also provided on the insides of the panels and extending parallel to said closure means and outwardly thereof to assist in gripping said panels when opening the bag, and the rib/groove configurations (14*a*, 14*b*) of the closure means (14) have a plurality of projections (19) thereon spaced apart along their length whereby during progressive engagement of the rib within its associated groove a series of audible and/or tactile signals will be provided signifying progressive closure of the closure means.

4 Claims, 1 Drawing Sheet

U.S. PATENT DOCUMENTS

| | | | | | |
|---|---|---|---|---|---|
| 4,929,487 | A | * | 5/1990 | Tilman et al. | 428/163 |
| 5,065,899 | A | | 11/1991 | Tilman | |
| 5,070,584 | A | | 12/1991 | Dais et al. | |
| 5,138,750 | A | | 8/1992 | Gundlach et al. | |
| 5,209,574 | A | * | 5/1993 | Tilman | 383/63 |
| 5,369,847 | A | * | 12/1994 | Naya et al. | 24/30.5 R |
| 5,384,942 | A | * | 1/1995 | Siegel | 24/585.12 |
| 5,442,838 | A | * | 8/1995 | Richardson et al. | 24/402 |
| 5,509,734 | A | * | 4/1996 | Ausnit | 383/63 |
| 5,573,614 | A | * | 11/1996 | Tilman et al. | 156/66 |
| 5,618,111 | A | | 4/1997 | Porchia et al. | |
| 5,647,100 | A | * | 7/1997 | Porchia et al. | 24/30.5 R |
| 5,839,831 | A | * | 11/1998 | Mazzocchi | 383/65 |
| 6,305,844 | B1 | * | 10/2001 | Bois | 383/64 |
| 7,287,904 | B2 | * | 10/2007 | Withers | 383/64 |
| 7,540,072 | B2 | * | 6/2009 | Anzini et al. | 24/399 |
| 2007/0206888 | A1 | * | 9/2007 | Chang | 383/200 |
| 2008/0159662 | A1 | * | 7/2008 | Dowd et al. | 383/63 |

FOREIGN PATENT DOCUMENTS

| | | | | |
|---|---|---|---|---|
| EP | 0427010 | A1 | | 5/1991 |
| EP | 0 543 737 | A1 | | 5/1993 |
| EP | 0543737 | A1 | | 5/1993 |
| JP | 08-058811 | | | 3/1996 |
| JP | 11171206 | | | 6/1999 |
| JP | 2000-309352 | | | 11/2000 |
| JP | 2000309352 | A | | 11/2000 |
| WO | WO 2006090693 | A1 | * | 8/2006 |

* cited by examiner

RECLOSABLE PLASTIC BAGS

TECHNICAL FIELD

This invention relates to reclosable plastic bags, that is, plastic bags which can be repeatedly opened and closed to receive or retrieve contents, and sometimes known as "zipper" bags.

BACKGROUND ART

Such bags conventionally are of rectangular configuration formed from an elongate plastic sheet or film folded upon itself to form two panels and sealed together along their opposite side edges with an opening defined by the free edges of the panels. The opening is adapted to be repeatedly opened and closed by closure/sealing means formed from a rib extending across one of the panels below the opening of the bag and inter-engaging in a groove formed between, and therefore defined by, two ribs extending across the other panel and also below the opening of the bag. Two parallel extending ribs on either sides of the rib which engages within the groove serve to capture the ribs within the defined groove.

The ribs and grooves are shaped and dimensioned so that the rib fits tightly within its associated groove and the ribs defining the associated groove deform to allow the rib to enter and to be captured within its associated groove. The bag is opened by gripping the free edges of the panel at the opening of the bag and pulling the panels apart with the rib disengaging from its associated groove thereby allowing access to the interior of the bag to receive or retrieve contents. To close or reseal the opening to the bag one end of the rib is pressed by thumb and finger pressure into the adjacent end of the associated groove with the thumb or finger under pressure being subsequently drawn along the length of the rib and groove arrangement to progressively introduce the rib into its associated groove to be tightly received therein and whereby to seal the opening of the bag.

The opening of the bag can be repeatedly opened and closed as required, with the closure process being analogous to that accomplished by a zipper and thus the term "zipper" is sometimes used to describe such reclosable bags.

With known reclosable or "zipper" bags, the portions of the two panels adjacent there free edges, and above the rib/groove closure means, have a plurality of parallel shallow ribs formed across the opening, usually on the inside of the panels, to allow secure finger gripping when those portions of the panels are gripped to pull the panels apart and disengage the closure means when opening the bag.

Reclosable bags, which are extruded through a die head have an area of weakness below the closure, that is, the bags are flimsy due to the thickness of the plastic sheet or film used to form the bag, and the plastic panels split or break below and/or above the closure if it is too tight and/or the user applies and/or maintains undue force when opening the bag, that is, the user is aggressive. But on the other hand for security, water tightness, and air tightness, a tight closure is required. In addition, the flimsy nature of the extruded closures makes them harder to engage and seal when closing. The filmsy nature of the material also makes it harder to control closure quality during production.

One solution to this problem has been to form the panels adjacent to closure from a plastic laminate with a profiled closure which provides added strength to resist splitting or breaking of the panels in the area of the closure, whilst the additional rigidity provided by the laminate makes it easier to engage the closure and seal the opening of the bag.

However, with reclosable bags having laminated plastic for the panels adjacent to closure means, the manufacturing costs are higher than for extruded closure bags because of the more sophisticated manufacturing equipment required, as well as the additional material costs, all adding to the cost of the bag to the consumer as compared with a bag having a simple extruded closure. There are also a limited number of suppliers of profiles to be used with a laminated construction, due to the very expensive set up costs for the production of profiles which are essential for a laminated construction.

It is therefore an object of one preferred embodiment of the present invention to provide a reclosable plastic bag having a closure formed by the simpler extrusion process and therefore without the additional cost factors associated with the laminated plastic alternative, but which also minimises, or eliminates, the problems with bags with conventional extruded closures.

DISCLOSURE OF THE INVENTION

The present invention therefore envisages a reclosable plastic bag having at least two panels of plastics sheet or film joined to, or integral with, each other, or a combination of both, to define a bag with an opening, a closure/sealing means of one or more inter-engagable elongate rib/groove configurations to close said opening, wherein at least one elongate strengthening rib is provided adjacent, and parallel, to said closure means and on one or each of the panels of the bag and also inwardly and/or outwardly of said closure means.

The closure means, the strengthening ribs, and any grip enhancing ribs, can also be formed by the simpler extrusion manufacturing process, whilst the strengthening ribs minimise, or eliminate, the problems with conventional extruded closures. In particular, the strengthening ribs bears some of the forces applied to the closure means and thus minimise the possibility of splitting or breaking of the bag material inwardly and/or outwardly of the closure means, whilst the strengthening ribs also stiffen the panels of the bag adjacent the closure means to provide additional rigidity to assist in aligning the inter-engaging rib/groove configurations when closing the bag. In addition it also enables the closure to be tighter for leak proofing, security, liquid and air tightness.

1, 2, 3, or even more, strengthening ribs may be provided both inwardly and outwardly of the closure means. Alternatively the ribs may consist of one wide rib. The ribs may be provided on the inside or outside of the bag and on one or both panels.

Preferably a plurality of shallow ribs are also provided on said panels extending parallel to said closure means and outwardly thereof to assist in gripping said panels when opening said bag.

The shallow ribs may be provided on the insides and/or outside one or both panels.

Preferably the rib/groove configurations of the closure means have a plurality of projections thereon spaced apart along their length whereby during progressive engagement of the rib within its associated groove a series of audible and/or tactile signals will be provided signifying progressive closure of the closure means.

BRIEF DESCRIPTION OF THE DRAWINGS

One preferred embodiment of the invention will now be described with reference to the accompanying drawings, in which.

BEST MODE FOR CARRYING OUT THE INVENTION

Figure 1:
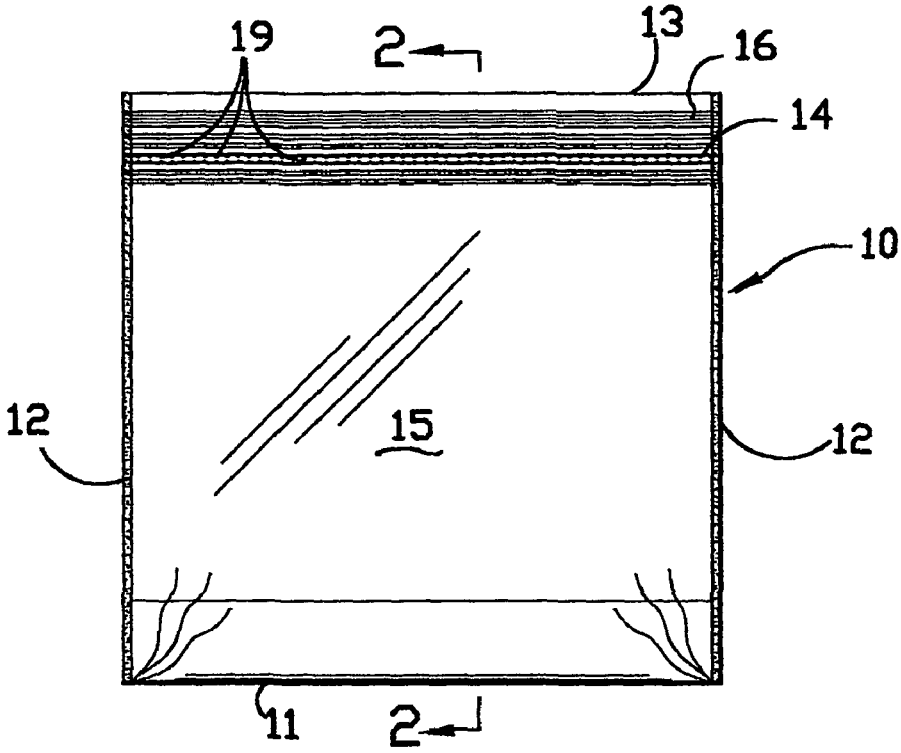
FIG. 1 is a side view of the reclosable plastic bag in accordance with this preferred embodiment of the invention.

In this preferred embodiment, the invention consists of a reclosable plastic bag, generally indicated as 10. The plastic bag is formed from an extruded tube of plastic sheet or film which when flattened produces a fold line 11 which will define the bottom of the bag, and which therefore produces a pair of panels 15 which are thereafter sealed along their opposite side edges 12 to provide a plastic bag having an opening 13 at the top of the bag when the other side of the tube is slit. The opening 13 is adapted to be repeatedly opened and closed by a conventional extruded closure/sealing means 14 of the type described above, and consisting of a rib 14*a* extending across the width of one panel at the opening of the bag and below the opening of the bag, and also engaging and captured within a groove 14*b* defined by a pair of ribs 14*c* extending across the width of the other panel of the bag at its opening. A pair of ribs on either side of the rib 14*a*, which engages within the groove 14*b*, serves to also capture the ribs 14*c* which define the grooves. Portions 16 at the top of the panels 15, and adjacent the free ends of the panels of the bag above the closure/sealing means 14 have parallel extending shallow ribs 17, also formed by extrusion, on their insides to allow secure gripping of the panels when those portions of the panels are gripped to pull the panels apart and to disengage the rib/groove closure means 14 when opening the bag.

Figure 2:
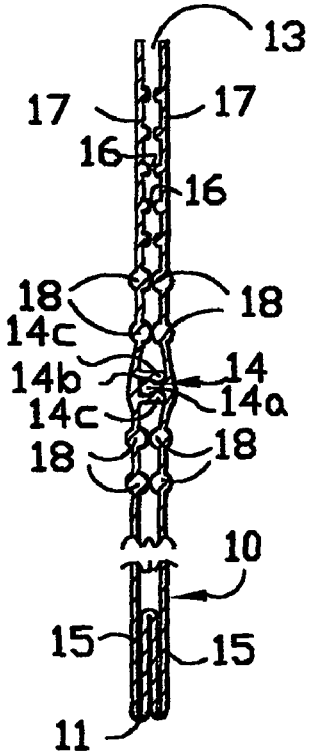
FIG. 2 is a broken enlarged cross-sectional view of the embodiment of FIG. 1.

In accordance with the present invention, a plurality, in this preferred embodiment two, parallel strengthening ribs 18 are also extruded along both sides of the closure/sealing means 14, to in effect bear some of the forces applied to the closure means 14 and thus minimise the possibility of splitting or breaking of the bag inwardly and/or outwardly of the closure means, whilst at the same time strengthening the panels of the bag adjacent the closure means to provide additional rigidity to assist in aligning the intergaging rib/groove closure configuration when closing the bag. As is perhaps best seen in FIG. 2, ribs 18 do not form part of closure means 14 and are separated from the closure means by an intervening portion of the associated panel 15, the ribs 18 extend laterally outwardly on both sides of the associated panel 15, the positioninci of ribs 18 on both sides of the panel 15 is symmetrical, and the ribs 18 on the panels 15 directly face each other.

In this preferred embodiment of the invention, the ribs 14*a* of the closure means 14 have a plurality of projections 19 provided and spaced apart along its length whereby, when progressively engaging the rib with its associated groove a series of audible and/or tactile signals will be produced signifying progressive closure of the closure means.

The closure/sealing means 14, the shallow ribs 17, and the strengthening ribs 18, are all extruded when the tube from which the bag will be formed is extruded and before the tube is slit.

The strengthening ribs 18 may be formed by altering the profile of the extrusion die, or by injecting plastics material directly onto the surface of the tube as it is being extruded, or by a forming process through a grooved die head also when the tube for the bag is being extruded. The more manufacturing and material costly laminating process could also be used if necessary.

The invention claimed is:

1. A reclosable plastic bag comprising:

two panels connected together to define a top opening therebetween;

two parallel spaced pairs of elongate strengthening ribs integrally formed on both inner and outer surfaces of each panel below the top opening; and inter-engagable elongate rib and groove elements integrally formed on inner surfaces of the panels between the two pairs of strengthening ribs, the rib and groove elements being both parallel to the strengthening ribs and spaced therefrom; and wherein the two pairs of strengthening ribs on the inner surface of one panel are mutually aligned and abutting with the two pairs of strengthening ribs on the inner surface of the other panel when the rib and groove elements on the panels are brought into engagement with each other to close the top opening.

2. A reclosable plastic bag as claimed in claim 1, wherein the strengthening ribs have a generally circular cross section with a generally semi-circular cross section on inner and outer surfaces of each panel.

3. A reclosable plastic bag as claimed in claim 1, further including a plurality of elongate shallow ribs integrally formed on inner surfaces of each panel between the top opening and the uppermost one of the two pairs of strengthening ribs.

4. A reclosable plastic bag as claimed in claim 1, wherein intermittent projections are spaced along the length of the rib element of the rib and groove elements.

* * * * *

UNITED STATES PATENT AND TRADEMARK OFFICE

CERTIFICATE OF CORRECTION

PATENT NO. : 7,651,271 B2
APPLICATION NO. : 10/415070
DATED : January 26, 2010
INVENTOR(S) : Philip Craig Withers It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 12 days.

Signed and Sealed this

Twenty-third Day of November, 2010

David J. Kappos

David J. Kappos
*Director of the United States Patent and Trademark Office*